US005727580A

United States Patent [19]

Patterson

[11] Patent Number: 5,727,580

[45] Date of Patent: Mar. 17, 1998

[54] GUTTER CLEANER

[76] Inventor: John W. Patterson, 20819 229th Pl., SE., Maple Valley, Wash. 98038

[21] Appl. No.: 650,130

[22] Filed: May 9, 1996

[51] Int. Cl.[6] ..... B08B 9/02

[52] U.S. Cl. ..... 134/115 R; 134/167 R; 134/201; 15/236.04; 401/137

[58] Field of Search ..... 244/19.3, 19.1, 244/22, 23, 24, 50.8, 50.9, 118; 134/167 C, 168 C, 169 C, 167 R, 166 R, 201, 115 R; 15/236.04; 401/289, 137

[56] References Cited

U.S. PATENT DOCUMENTS

| | | | |
|---|---|---|---|
| 888,229 | 5/1908 | Elmberg | 294/118 |
| 1,588,927 | 6/1926 | Willis | 194/118 |
| 1,763,437 | 6/1930 | Munkelwitz | 294/118 |
| 2,639,935 | 5/1953 | Foilke | 294/50.8 |
| 3,023,971 | 3/1962 | Milhous | 134/167 C |
| 3,041,655 | 7/1962 | Entler | 401/137 |
| 3,328,066 | 6/1967 | Johnston | 294/118 |
| 3,601,835 | 8/1971 | Morgan . | |
| 3,720,409 | 3/1973 | Griffith | 294/19.1 |
| 3,743,339 | 7/1973 | Brackett . | |
| 3,907,354 | 9/1975 | Ocampo | 294/19.1 |
| 3,972,552 | 8/1976 | Earp, Jr. . | |
| 4,057,276 | 11/1977 | Currie . | |
| 4,114,938 | 9/1978 | Strada . | |
| 4,310,940 | 1/1982 | Moore . | |
| 4,319,851 | 3/1982 | Arthur | 401/137 |
| 4,750,883 | 6/1988 | Drake | 401/289 |
| 4,848,818 | 7/1989 | Smith | 15/236.04 |
| 4,930,824 | 6/1990 | Matthews . | |
| 5,114,199 | 5/1992 | Newcomer | 294/50.8 |
| 5,310,381 | 5/1994 | Green . | |

FOREIGN PATENT DOCUMENTS

| | | | |
|---|---|---|---|
| 39087 | 3/1909 | Austria | 294/50.9 |
| 69740 | 8/1941 | Norway | 294/50.8 |
| 252241 | 5/1926 | United Kingdom | 294/22 |

*Primary Examiner*—Frankie L. Stinson

*Attorney, Agent, or Firm*—Marger Johnson McCollom & Stolowitz, P.C.

[57] ABSTRACT

An apparatus and method for cleaning overhead gutters. The apparatus includes two inverted J-shaped members connected by a hinge at the apex. Each J-shaped member has a scoop depending downwardly from the apex and a handle arm depending downwardly from the apex, the handle arm being longer than the scoop. The J-shaped members are hinged such that rotating the handle arms toward each other causes the scoops to rotate toward each other thereby grasping debris therebetween. The scoops are pliable and ellipsoidal shaped and can have teeth or bristles. The hinge provides fulcrum type leverage for grasping and dislodging debris. The J-shaped members can be snapped into and out of the hinge. The gutter cleaner includes a coupling for connecting the cleaner to a garden hose through a valve. Water is channeled to a scoop where a baffle directs the water into the scoop and under debris to dislodge and consolidate debris. The handle arms include slidable hand grips, and extension arms can be connected to the handle arms. A pivot joint can be connected between a handle arm and an extension arm. A mirror can be mounted near the apex of the gutter cleaner. The method includes rotating the handle arms and scoops apart, discharging water into the scoops, sliding the gutter cleaner along the gutter to dislodge and accumulate debris in front of a scoop, rotating the scoops together to grasp the accumulated debris, and lifting the debris from the gutter.

26 Claims, 7 Drawing Sheets

GUTTER CLEANER

BACKGROUND OF THE INVENTION

1. Field of the Invention

This invention relates generally to cleaning tools and more particularly to tools for cleaning eavestroughs or rain gutters.

2. Description of the Related Art

In many locations throughout the world, organic debris such as deciduous leaves, pine needles & moss present a continuous source of material which falls upon the roofs of houses. Such material ultimately is transported via wind and rain into the gutters causing damage to their structure and requiring continuous maintenance of the system. Presently there are 3 distinct methods for eliminating accumulated debris. One method employs screens or permeable drain covers. Though this method usually requires little upkeep once installed, these covers merely act as a ramp to transfer the debris onto shrubbery, walkways and flower beds. And even permeable covers become clogged and periodically require removal and cleaning. The second approach involves intrusive sub-systems which are difficult to install or retrofit. Besides the extensive labor of installing, none of them are compatible with the large variety of shapes that are presently in use. The third method of maintenance involves the use of some form of tool, usually, manual, but sometimes semi-automatic. Over the years the need for maintaining rain gutter systems has spawned a diverse array of gadgets, none of which provided an effective solution. Cleaning gutters using present technologies is not only an arduous and time consuming task, but also a potentially dangerous one. None of the available products allow a person to effectively clean a gutter from ground level. Therefore a person must either climb a ladder, or access the gutter by crawling along the roof. Both of these methods are potentially hazardous to one's health as well as to one's property. Even "professional gutter cleaners" are prone to these inherent dangers. Many of the tools, sub-systems or permeable covers that are available are not only inefficient at solving the problem, but often they are self-defeating or cause new problems.

Numerous and sundry hand tools have been proposed for manually cleaning rain gutters. Many of these tools are only functional only if a person is stationed at roof level. This means that access to the gutter must either be accomplished by crawling along the eave of the roof or by positioning oneself atop a ladder or other elevated pedestal. Besides the inherent danger of such orientation, there is usually a great deal of difficulty negotiating shrubbery, fences and flower gardens. Soil which is directly adjacent to structures is notorious for being unstable in texture and therefore difficult to achieve a firm footing for a ladder. This not only invites the possibility of personal injury by the ladder toppling onto the ground; but there is also a good chance that a person will damage the gutter structure either by leaning the ladder against it or grasping the gutter to retain ones balance. The majority of tools designed to be operated at roof level do not facilitate the use of water because of the difficulty of manipulating an attached hose in such a precarious position. Cleaning debris from gutters also necessitates disposal of such debris. People who clean their gutters from roof level usually do not like to see the debris discarded haphazardly on to the walkways and shrubbery below them. Therefore some procedure must be incorporated to enable collection of the debris for transportation elsewhere. It is not uncommon in heavily wooded parts of the world for gutters to accumulate in excess of one hundred pounds of debris annually.

Translated into volume this entails a sizeable amount to be transported. Whether a person uses a trash bag, wheelbarrow, bucket or any other similar container, the job is very inconvenient. If one uses a ladder, it must be picked up and restabilized after cleaning approximately four feet of the gutter. The wheelbarrow or container must also be moved. If one is accessing the gutter by crawling along the eave the job is probably no easier or safer. Even if one is not injured seriously, he or she can count on sore muscles, knees and hands once the job is done. Besides the danger and cumbersomeness of this form of gutter maintenance one can also add the messiness which leaves both body and clothes dirty and worn.

Several tools have been proposed that attempt to solve the above problems by a tool that can access the roof gutter by a person standing on the ground. One such tool is U.S. Pat. No. U.S. 3,601,835 issued Aug. 31, 1971 to Morgan. This tool is comprised of a single, tubular, telescopic arm and the use of a rope or non-rigid wire to actuate grasping jaws. Though tubular, the arm is incapable of acting as a viaduct for water. The telescopic segments to adjust height do not incorporate water seals. Also each segment of tube has a series of spaced holes which penetrate their wall for the purpose of inserting a removable support pin or screw diminishing the structural integrity of the arm and making it pervious to water. Unfortunately this device has several shortcomings: Its inability to transport water, an important medium for dislodging as well as consolidating debris. Its complexity of design make tooling and labor costs too expensive to produce and whenever there are extensive pieces of removable hardware this lends itself to the probability that parts might come off during shipment, display or after product is purchased. Another disadvantage in the design of this invention is the rigid construction of the grasping components. There are numerous and sundry gutter sectional profiles and rigid grasping heads cannot accommodate these variances. Possibly the most significant shortcoming is the fact that this device incorporates only one arm. A person using this device must manipulate the main structure including its own weight plus the added weight of debris using only one hand since the second hand must be dedicated to manipulation of the wire or rope. This reduction in leverage becomes all the more important when trying to dislodge material that may be trapped by a tree branch or entrenched beneath a ferrule. Incorporation of a wire or rope also lends itself to a high probability of the rope becoming entangled in adjoining shrubbery or might snag on the protruding edge of a shingle or the trough itself.

U.S. Pat. No. 3,743,339 issued Jul. 3, 1973 to Brackett, discloses a tool that incorporates a tubular telescopic arm and the use of a rope or non-rigid wire to actuate a sliding jaw mounted on an elongated carriage. The arm, though tubular, is incapable of acting as a viaduct for water because portions of this shaft incorporate pulleys used to guide the rope. Unfortunately this device also has several shortcomings: Its inability to transport water, an important medium for dislodging as well as consolidating debris. Its complexity of design and fabrication make tooling and labor costs exorbitant, especially considering threading a series of internal pulleys. Again it is important to point out that whenever there are extensive pieces of removable hardware this lends itself to the probability that parts might come off during shipment, display or after product is purchased. Because the actuating wire is encapsulated in the neck of this device the invention becomes nearly impossible to mend if the wire were to break. There is also disadvantage in that the rigid construction of the grasping components are not compatible with the variety of gutter sectional profiles. The actuation wire or rope can easily entangle in adjoining shrubbery or snag on sharp edges of the gutter. Again the most significant shortcoming of this device appears to be that it incorporates only one arm. A person using such a tool must manipulate and support its own weight plus the added weight of debris using only one hand since the second hand is needed to manipulate the wire or rope. This loss of leverage becomes even more significant when trying to dislodge material that is trapped by a tree branch or entrenched beneath a ferrule.

U.S. Pat. No. 3,972,552 issued Aug. 3, 1976 to Earp, discloses a tool that again incorporates a tubular telescopic arm and the use of a rope or non-rigid wire to actuate a grasping jaw. The arm, though tubular, is not intended to act as a viaduct for water. Unfortunately this device also has several shortcomings: Its inability to transport water, an important medium for dislodging as well as consolidating debris. Its complexity of design and fabrication make tooling and labor costs too expensive. Again it is important to point out that whenever there are extensive pieces of removable hardware this lends itself to the probability that parts might come off during shipment, display or after product is purchased. The long, slender segments of the mechanism appear prone to damage by bending. The extended rod fingers on the grasping head will inevitably snag overhanging shingles. There is also disadvantage in that the rigid construction of the grasping components are not compatible with the variety of gutter sectional profiles. A person using such a tool must manipulate and support its own weight plus the added weight of debris using only one hand since the second hand is needed to manipulate the wire or rope. This loss of leverage becomes even more significant when trying to dislodge material that is trapped by a tree branch or entrenched beneath a ferrule. The actuation wire or rope is also prone entangle in adjoining shrubbery or snag on sharp edges of the gutter.

U.S. Pat. No. 4,057,276 issued Nov. 8, 1977 to Currie discloses a tool that incorporates a single, tubular arm. The arm is extendable when a male plug on one segment inserts into a female socket on the adjoining segment where it is secured via a cotter pin. The grasping jaws are again activated by the use of a rope or non-rigid wire attached to a pair of extraordinarily large grasping jaws. The arm, though tubular, is not intended to act as a viaduct for water. Unfortunately this device also has several shortcomings: Its inability to transport water, an important medium for dislodging as well as consolidating debris. There appears to be several major flaws in this design. The large size of the grasping scoops would make operating this device very difficult. The wire/robe which draws the jaws would require an excessive downward pull and would in all probability weaken the gutter structure long before it closed upon the debris. The fact that organic debris is most often cemented together by mud and other dissolved organic materials would appear to render this invention inoperable. Again the disadvantage of rigid grasping scoops such as those shown are not compatible with the variety of gutter sectional profiles. As with the previous inventions, because this device incorporates a single arm, it therefore lacks the leverage necessary to dislodge and lift material that may be trapped by a tree branch or entrenched beneath a ferrule. The actuation wire or rope is prone to entangle in adjoining shrubbery or snag on sharp edges of the gutter.

U.S. Pat. No. 4,114,938 issued Sep. 19, 1978 to Strader discloses a tool that incorporates a single, telescopic, tubular arm. The grasping jaws are paddle-shaped and again activated by the use of a rope or non-rigid wire. The arm, though tubular, is not intended to act as a viaduct for water. The shortcomings of this device are similar to the previous examples of prior art: Inability to transport water, an important medium for dislodging as well as consolidating debris. Again the disadvantage of rigid grasping scoops such as those shown are not compatible with the variety of gutter sectional profiles. As with the previous inventions, because this device incorporates a single arm, it therefore lacks the leverage necessary to dislodge and lift material that may be trapped by a tree branch or entrenched beneath a ferrule. The actuation wire or rope is prone to entangle in adjoining shrubbery or snag on sharp edges of the gutter.

U.S. Pat. No. 4,310,940 issued Jan. 19, 1982 to Moore discloses a tool that incorporates a single, telescopic, tubular arm. The grasping alligator-like jaws attack the debris on a horizontal plane, but unlike the previously described patents, it incorporates a handle concentric to the arm which slides up and down driving a rod which, in turn, via a U-joint transmits the motion into raising and lowering the upper portion of the jaws. Again the arm is not intended to act as a viaduct for water, and is suggested to be solid. The shortcomings of this device are similar to the previous examples of prior art: Inability to transport water, an important medium for dislodging as well as consolidating debris. The complexity of the mechanism would make it not be cost effective. The jaws open and close vertically and by the lack of any inward curvature appear unadapted for consolidating and holding materials that may be compressed and cemented. Again the jaws shown, being rigid, are not compatible with the variety of gutter sectional profiles. As with the previous inventions, because this device incorporates a single arm, it therefore also lacks the leverage necessary to dislodge and lift material that may be trapped by a tree branch or entrenched beneath a ferrule.

U.S. Pat. No. 4,930,824 issued Jun. 5, 1990 to Mathews and Ricketts discloses a tool that incorporates a single, telescopic, tubular arm with jaws activated by a wire or rope. The grasping rake-shaped jaws appear to grasp the debris on a plane vertical to the trough. Again the arm is not intended to act as a viaduct for water, and is suggested to be solid. The shortcomings of this device are the fact that they are not only limited in the breadth of the jaws, but are not designed to move the debris horizontally, therefore consolidating it. Inability to transport water, an important medium for dislodging as well as consolidating debris. The complexity of the mechanism would make it too expensive to market. Because the jaws close perpendicular to the longitudinal plane of the gutter, they appear better able to adjust to the variety of gutter sectional profiles. Unfortunately this greatly limits the quantity the jaws are able to access during each operation. As with the previous inventions, because this device incorporates a single arm, it therefore also lacks the leverage necessary to dislodge and lift material that may be trapped by a tree branch or entrenched beneath a ferrule. Also the wire or rope is prone to snagging on shrubs and other obtrusions.

Accordingly, a need remains for a tool which is better adapted to the inherent problems related to the removal of compacted gutter debris.

SUMMARY OF THE INVENTION

It is, therefore, an object of the invention to clean a rain gutter from a remote position.

Another object of the invention is to provide a cleaning tool that provides increased leverage for dislodging debris from a gutter.

Another object of the invention is to provide an improved technique for dislodging and consolidating debris from a gutter.

Another object of the invention is to clean gutters having a variety of cross sectional shapes.

Another object of the invention is to clean gutters made from a variety of different materials.

A further object of the invention is to provide a gutter cleaning tool that is inexpensive and reliable.

One aspect of the present invention is a gutter cleaner comprising a first inverted J-shaped member having a scoop, a handle arm, and an apex portion, and a second inverted J-shaped member having a scoop, a handle arm, and an apex portion, the first and second J-shaped members pivotally connected near the apex portions such that the scoops pivot toward each other as the handle arms are pivoted toward each other.

The gutter cleaner can include a hinge for pivotally connecting the first and second J-shaped members. Such a hinge can include a cylindrical race, and the first J-shaped member can include a cylinder-shaped journal portion so that the journal portio can be portion disposed within the race. The hinge can include a slot communicating with the race along the entire length of the race, the slot having a width less than the diameter of the journal so that the journal can be snapped into the race.

The scoop of the first J-shaped member and the apex portion can be joined at approximately a 90 degree angle, and the handle arm and the apex portion can be joined at approximately a 60 degree angle.

The first J-shaped member can include a passageway for transporting fluids to the scoop, and a baffle that directs fluids into the scoop. A coupling communicating with the passageway can be mounted on the handle arm, and a valve can be used to coupled a hose to the passageway.

The scoops can include one or more teeth or bristles, can be ellipsoidal shaped and can be made from a pliable material. The gutter cleaner can include a handle grip attached to the handle arm of the first J-shaped member which slides along the handle arm. A mirror can be mounted near the apex of the first J-shaped member.

The gutter cleaner can include an extension arm connected to the handle arm of the first J-shaped member and a pivoting joint connected to the handle arm of the second J-shaped member with another extension arm connected to the pivoting joint.

Another aspect of the present invention is a method for cleaning a gutter trough including the steps of inserting a first scoop into the gutter trough; sliding the first scoop along the gutter trough to accumulate debris pivoting a second scoop toward the first scoop thereby grasping the accumulated debris with the scoops; and lifting the scoops from the gutter trough, thereby removing the debris. The method can also include the step of discharging a fluid into the first scoop.

The incorporation of two arms provides several advantages over single-armed tools. One advantage is leverage. An advantage of increased leverage involves the initial entrance of the tool into organic debris which is often intertwined with twigs and branches as well as cemented together by organic adhesives. The initial function of a gutter cleaning tool is penetration and breaking up the debris. Only after the material is broken up and separated can it be removed. By incorporating a fulcrum-like hinge at the upper end of the tool the user gains significant leverage. This leverage is first translated into the necessary force required to manipulate and sever the indurated material. Increased leverage also plays an important role in pushing the severed segment along the trough, allowing it to accumulate into a compressed pile. And finally this leverage allows the two arms to swing together clamping a significant amount of material and placing the handle in parallel proximity. At this point the horizontal leverage changes to vertical leverage as the mass of debris can now be lifted from the trough using both hands mutually grasping both arms. This vertical leverage is of great importance because the debris being removed quite often hangs up on the protruding shingles on one side and the inward bend of the gutter lip on the opposite side. Ferrules also impede removal especially when twigs and branches are prevalent in the debris. Leverage is also important in transporting the material from the roof and depositing the debris in a wheelbarrow or other container.

The grasping/scoop appendages at the end of the arms which dislodge and remove the debris are another improvement over the aforementioned prior art. Because they are fabricated from injection molded plastic alloy they are less likely to scratch or bind when in contact with the thin-walled gutter structure. Being of pliable plastic alloy, they will not only fail to bind or scratch the metal or vinyl gutters, but their flexibility enables them to conform to the variations in gutter profiles. The ladle shape of these scoops serve several purposes which also are improvements over prior art. Their shape causes compression of the material into an elongated ellipsoid. This makes the debris less likely to snag on obstacles as it is lifted from the trough.

The scoop incorporates a baffle which is designed to direct water passing through the arm to exit the scoop along its inside surface. This surface being curved tends to direct the water beneath the material. This not only helps to dislodge debris which may be adhering to the wall, but it also tends to move and consolidate finer materials such as pine needles and shingle sand. None of the aforementioned inventions takes into consideration removal of this finer debris. The final advantage of this invention's scoops is that they are unibodied articles, employing no hardware or pre-assembled parts. Therefore the cost of these appendages is far less than those shown in prior art.

The hinge incorporated near the upper end is also made of plastic alloy. It is made from a more rigid alloy to maintain greater rigidity at the fulcrum point. Depending on configuration, the hinge may be attached during or after the tubing is bent. The hinge incorporates other advantages such as a means for easily detaching both component parts. This allows advantages in both efficiency of packaging and storage as well as enabling a person to detach and use only one of the arms to purge the system of debris too small to pick up with the scoops.

The handle grips are another improvement over prior art. Made of a supple, plastic alloy such as low density, polypropylene, they offer a firmer hold on the arms. They are designed with enough flexibility to allow them to be slipped up or down the arms so as to adjust to the comfort of the user.

On the lower end of each arm a brass, female garden hose coupling is press fitted. This allows attachment of a hose to either end thus adapting to either right or left handed use. A single removable on/off ball valve is screwed into one of the female couplings. Having male threads on one end and female on the opposite, it can be installed in series with the hose and can also be attached to either arm.

The arms used in this invention incorporate two bends made on or about the same lateral plane. The bend closest to the upper end would be 90 degrees and the second bend about 60 degrees. The spacing of these two bends is an important feature of the invention. Because the two ladle scoops need to remain in mirror image alignment, the bends are separated by the width of the hinge. In so doing the shafts cannot move forward or backwards relative to each other and no mechanical attachment need be required to prevent such movement. Extension arms can be easily added if necessary to access higher than normal gutters. These extensions could be of varying length and would incorporate a male hose coupling on the top end and a female coupling on the lower end. One extension would be constructed as a single uninterrupted segment of tubing. The second arm would incorporate a u-joint hinge. When using the extension a person pushes the arm with the u-joint hinge upwards vertically. The u-joint coupling transfers this upward force outward causing the upper arm to swing outward thus causing the scoops to close and grasp the debris.

The foregoing and other objects, features and advantages of the invention will become more readily apparent from the following detailed description of a preferred embodiment of the invention which proceeds with reference to the accompanying drawings.

DETAILED DESCRIPTION

Figure 1:
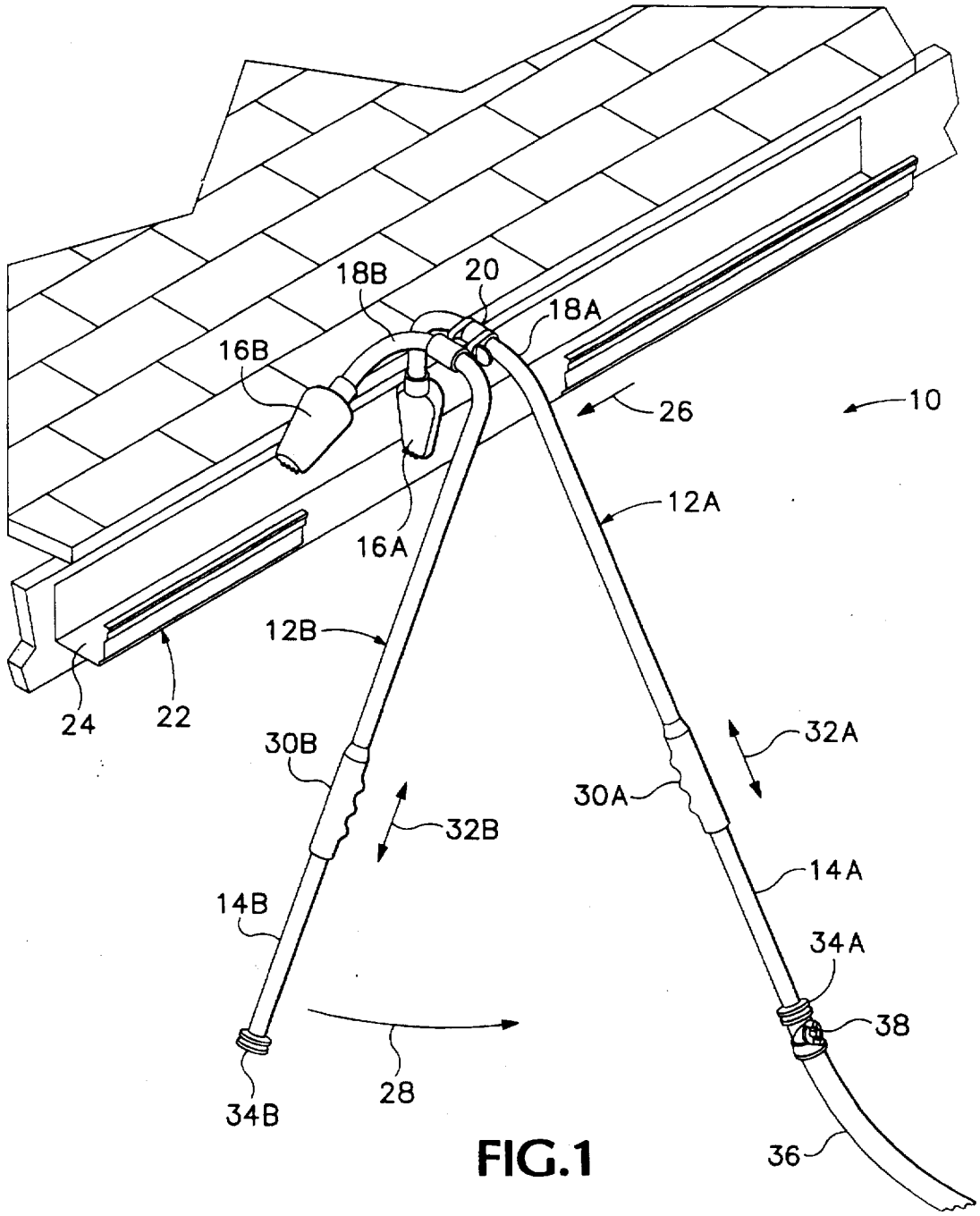
FIG. 1 is a perspective view of an embodiment of a gutter cleaner in accordance with the present invention.

Indicated generally at 10 in FIG. 1 is an embodiment of a gutter cleaner in accordance with the present invention. Prior to describing the detailed structure of the invention, the key components will be identified followed by a brief description of the operation of the system. Then a more detailed description of each of the components will be provided along with a more detailed description of the operation.

A right inverted J-shaped member 12A includes a handle arm 14A, a scoop 16A and an apex portion 18A. A left inverted J-shaped member 12B includes a handle arm 14B, a scoop 16B and an apex portion 18B. J-shaped members 12A and 12B are pivotally joined near their respective apex portions by a hinge 20.

The gutter cleaner 10 can be operated in wither a left-hand mode or a right-hand mode. In the right hand mode of operation, the J-shaped members 12A and 12B are first pivoted apart to place the cleaner 10 in an open configuration as shown in FIG. 1. The right hand scoop 16A is inserted into the trough 22 of rain gutter 24. The entire cleaner 10 is then moved to the left as shown by arrow 26, thereby dislodging and consolidating debris in front of scoop 16A. The handle arm 14B of left J-shaped member 12B is then pivoted toward the handle arm 14A of right J-shaped member 12A as shown by arrow 28, thereby causing the consolidated debris to be grasped between scoops 16A, 16B. The entire cleaner 10 is then lifted vertically, thereby removing the debris from the gutter.

Handle grips 30A and 30B are mounted on handle arms 14A and 14B, respectively, to improve leverage and comfort. Handle grips 30A and 30B slide along the handle arms as shown by arrows 32A and 32B to adjust for the operator's height.

J-shaped members 12A and 12B include couplings 34A and 34B mounted to the respective ends of handle arms 14A and 14B. In the right-hand mode of operation, coupling 34A connects a hose 36 to an internal passageway (not shown) in right J-shaped member 12A, preferably through shut off valve 38. The internal passage connects the coupling to scoop 16A. In operation, pressurized water or other cleaning fluid from hose 36 is channeled through the valve, coupling, and internal passage to scoop 16A. The fluid is directed into the scoop by a baffle (not shown) to assist in dislodging and consolidating debris. Left J-shaped member 12B has a similar fluid passage structure and operation.

More detailed consideration will now be given to the structure of the gutter cleaner 10 of the present invention.

Figure 2:
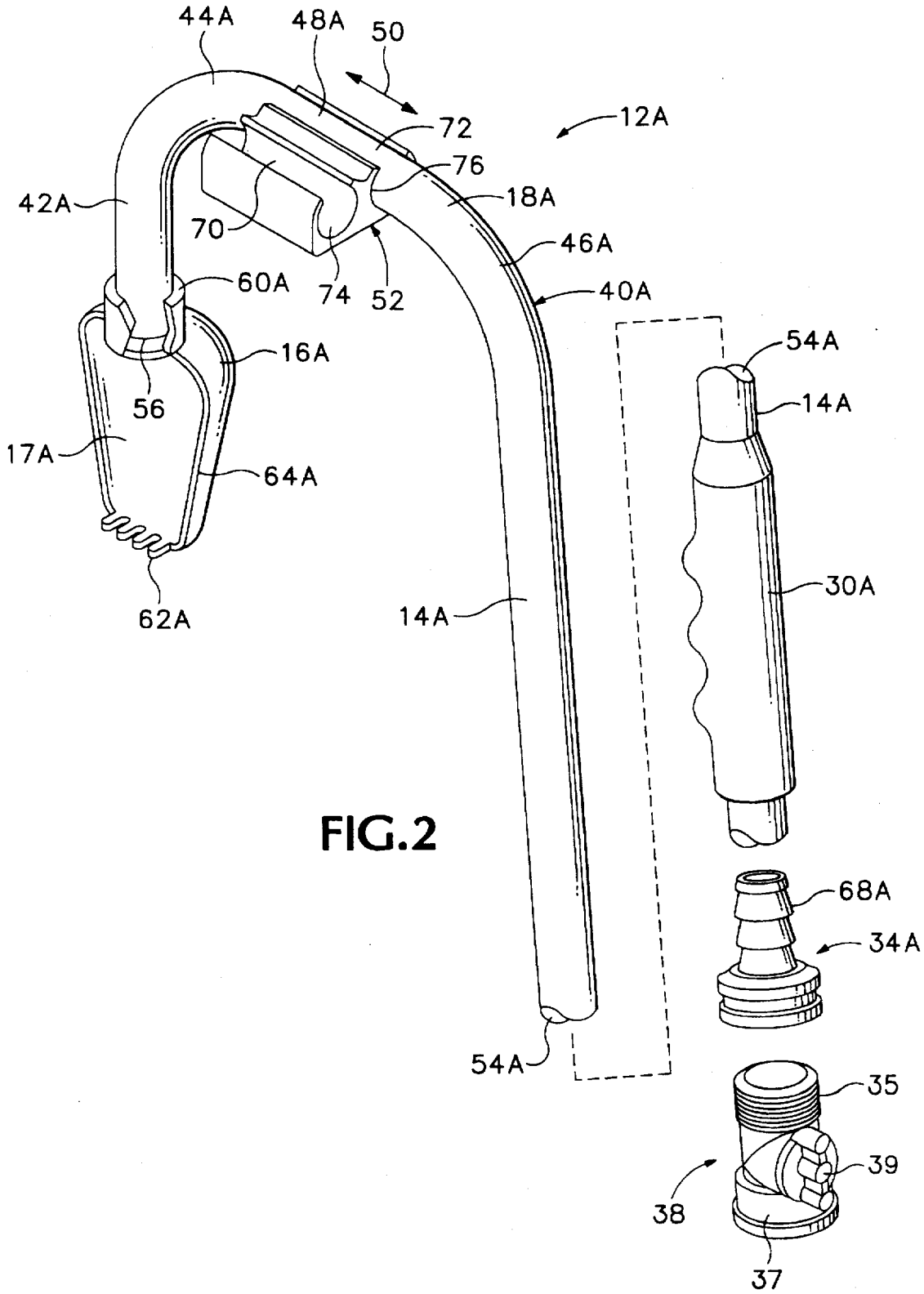
FIG. 2 is a perspective view showing a portion of the gutter cleaner of FIG. 1 with portions cut away to show more detail.

Referring to FIG. 2, right inverted J-shaped member 12A includes a scoop arm 42A and a journal portion 48A, both of which are straight cylindrical tubes. Scoop arm 42A is joined to a first end of journal portion 48A at approximately a 90 degree angle by a first tubular elbow 44A. The axis of journal 48 is generally held in a horizontal orientation when the gutter cleaner 10 is in operation. Thus, the axis of scoop arm 16A is generally oriented in a vertical direction. J-shaped member 12A also includes a straight cylindrical handle arm 14A which is joined to the second end of journal portion 48A at approximately a 60 degree angle by a second tubular elbow 46A. The scoop arm, first elbow, journal portion, second elbow, and handle arm are joined such that they all lie in approximately the same plane and form a rigid tube 40A which is generally J-shaped. Rigid tube 40A has an internal passageway 54 which runs the entire length of the tube, and the tube is essentially liquid tight along its entire length except for circular orifices 56 and 58 at either end.

Rigid tube 40A is preferably made from a single piece of cylindrical aluminum alloy tubing type 6061-T6 or equivalent, has an outside diameter of 0.75 inches, a wall thickness of 0.05 inches, and a total length of approximately 50 inches. The scoop arm 42A, and journal portion 48A are each approximately 3 inches long. The first and second elbows 44A and 46A have a bend radius of approximately 3 inches. Rigid tube 40A is formed by leaving a 3 inch straight length at one end for scoop arm 42, then bending the tubing at approximately a 3 inch radius to form a first elbow 44 having curvature of approximately 90 degrees. Another straight section is left for journal portion 48, and then the tubing is bent at a 3 inch radius again to form second elbow 46 which has a curvature of approximately 60 degrees and is substantially coplanar with the first elbow. The remaining straight section forms the handle arm 14A. The length of journal section 48 is determined by the distance between elbows 44 and 46 and is preferably approximately equal to the length of hinge 20. If hinge 20 does not have an opening for assembling the hinge to the journal 48 of the J-shaped member, then the hinge must be assembled to the journal before the second bend is made.

First J-shaped member 12A includes a ladle-shaped scoop 16A having a generally planar rim 64A that is generally elliptical shaped with the main axis of the ellipse oriented in a generally vertical direction. The scoop 16A has an ellipsoidal shaped inner surface 17A. Scoop 16A also includes a cylindrical tubular coupling 60A at the top end which protrudes from the scoop such that the axis of the coupling 60A is substantially aligned with the plane of rim 64A. The scoop also includes one or more teeth 62A mounted at the bottom end of the scoop near the rim and protruding normally from the plane of the rim. The scoop 16A is attached to the rigid tube 40A by sliding the coupling 60A over the free end of scoop arm 42A, thereby forming a substantially fluid-tight seal between the passageway of the rigid tube and the scoop. The coupling can have either a slip-fit or an interference-fit on the rigid tube.

Figure 3:
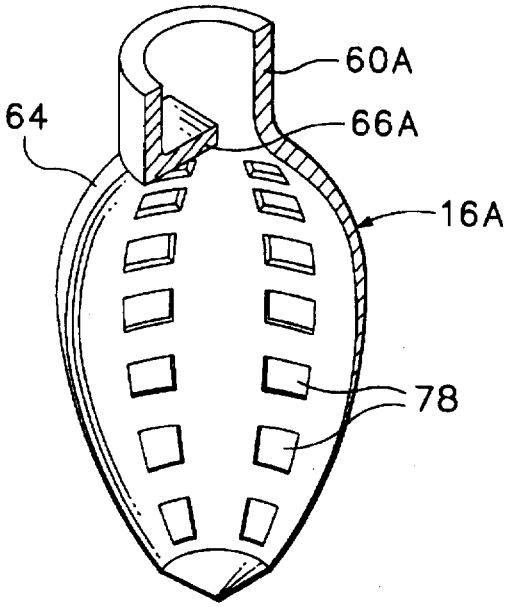
FIG. 3 is a perspective view of an embodiment of a scoop of the gutter cleaner of FIG. 1 in accordance with the present invention with portions cut away to show more detail.

Scoop 16A also includes a baffle 66A located at the lower end of coupling 60A for projecting pressurized fluids flowing through the passage 54A into the curved inner surface of the scoop. The baffle 66A is not visible in FIG. 2, but it is visible in the scoop shown in FIG. 3. FIG. 3 shows an alternative embodiment of scoop 16A having openings 78 to allow fluid to drain from the scoop. The location and design of baffle 66A is substantially the same for the scoop shown in FIG. 2. The baffle may be straight or semi-circular in shape. The scoop is preferably made from a pliable or semi-liable plastic such as polypropylene alloy.

Figure 4:
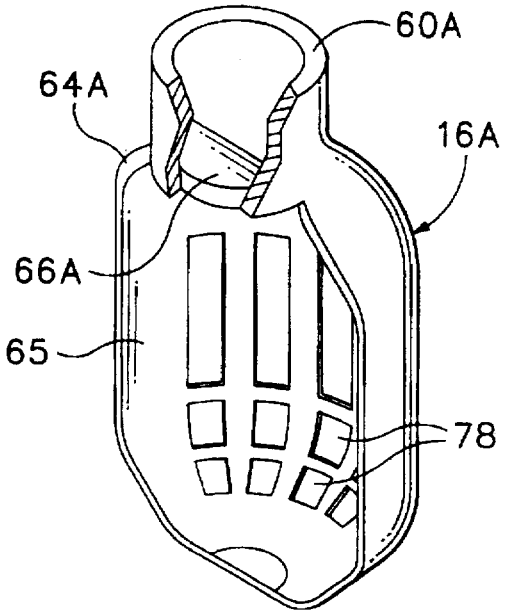
FIG. 4 is a perspective view of an embodiment of a scoop of the gutter cleaner of FIG. 1 in accordance with the present invention.

FIG. 4 shows another alternative embodiment of scoop 16A. This embodiment includes straight sidewalls 65 and a baffle 66.

Figure 5:
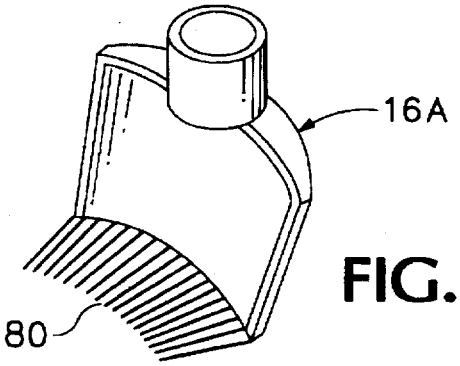
FIG. 5 is a perspective view of an embodiment of a scoop of the gutter cleaner of FIG. 1 in accordance with the present invention.

FIG. 5 shows another alternative embodiment of scoop 16A. This embodiment includes a row of bristles 80 mounted along the bottom of the rim of the scoop.

Referring again to FIG. 2, J-shaped member 12A includes a threaded hose coupling 34A attached to the free end of handle arm 14A. The coupling includes a barbed connector 68A that is disposed within rigid tube 40A and provides a substantially liquid-tight seal between the coupling 34A and the tube 40A. The coupling is preferably made from brass or other rigid, corrosion resistant material and has female pipe threads suitable for connection to a common garden hose. The barbed connector 68 A of the coupling is preferably press-fit into rigid tube 40A.

J-shaped member 12A also includes a tubular handle grip 30A that is slip-fit on handle arm 14A such that the grip can be slid up and down on the arm. Handle grip 30A is preferably made from a supple plastic alloy such as low density polypropylene.

Left J-shaped member 12B is substantially identical to member 12A and has all of the same components, the only difference being the orientation of the scoop 16B which is mounted so that the rim of scoop 16B faces the rim of scoop 16A when the two J-shaped members are assembled with hinge 20 as shown in FIG. 1.

Referring again to FIG. 2, an embodiment of hinge 20 is shown at 52. Hinge 52 includes two substantially parallel races 74 and 76. The hinge also includes two slots 70 and 72 which communicate with the races for the entire length of the races. The slots have a width such that, if the hinge is made from a semi-pliable plastic alloy, journal 48A can be snapped into race 76. Likewise, the journal on the left J-shaped member 12B can be snapped into race 74. The length of races 74 and 76 is selected to be close to the length of the journals on the J-shaped members so that the hinge is held captive between the elbows of the J-shaped members thereby preventing the J-shaped members from moving laterally relative to the hinge and each other as shown by arrow 50. Hinge 52 is preferably manufactured from injection molded plastic alloy.

Referring to FIG. 1, right J-shaped member 12A and left J-shaped member 12B are pivotally joined by hinge 20 to allow latitudinal rotation of member 12A relative to member 12B such that the scoops 16A and 16B pivot toward each other as the handle arms 14A and 14B are pivoted toward each other.

Figure 6:
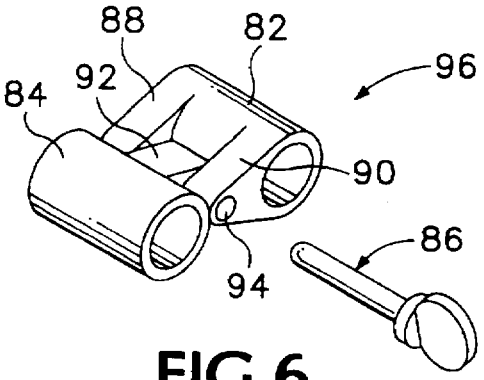
FIG. 6 is a perspective view of an embodiment of a hinge in accordance with the present invention.

FIG. 6 shows an alternative embodiment of a hinge generally at 96. This embodiment includes a first cylindrical sleeve 82 having two hinge lobes 88 and 90 protruding form the side of the sleeve. Hinge 96 also includes a second cylindrical sleeve 84 having a single lobe 92 protruding from the side of the sleeve 84. The two sleeves can be pivotally joined by a removable pin 86 which can be inserted into a hole 94 which runs through all hinge lobes 88, 90, 92.

Figure 7:
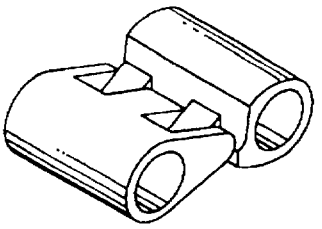
FIG. 7 is a perspective view of an embodiment of a hinge in accordance with the present invention.

FIG. 7 shows another alternative embodiments of hinge 20. This hinge is similar to the hinge of FIG. 6, but the pin is captive within the hinge lobes.

Referring to FIG. 1, a common garden hose 36 can be connected to either the right or left coupling 34A,B either directly, or through valve 38. Referring to FIG. 2, valve 38 is a commercially available ball valve having a male hose thread coupling 35 at one end and a female hose thread coupling 37 at the other. The valve ball is actuated by knob 39.

Figure 8:
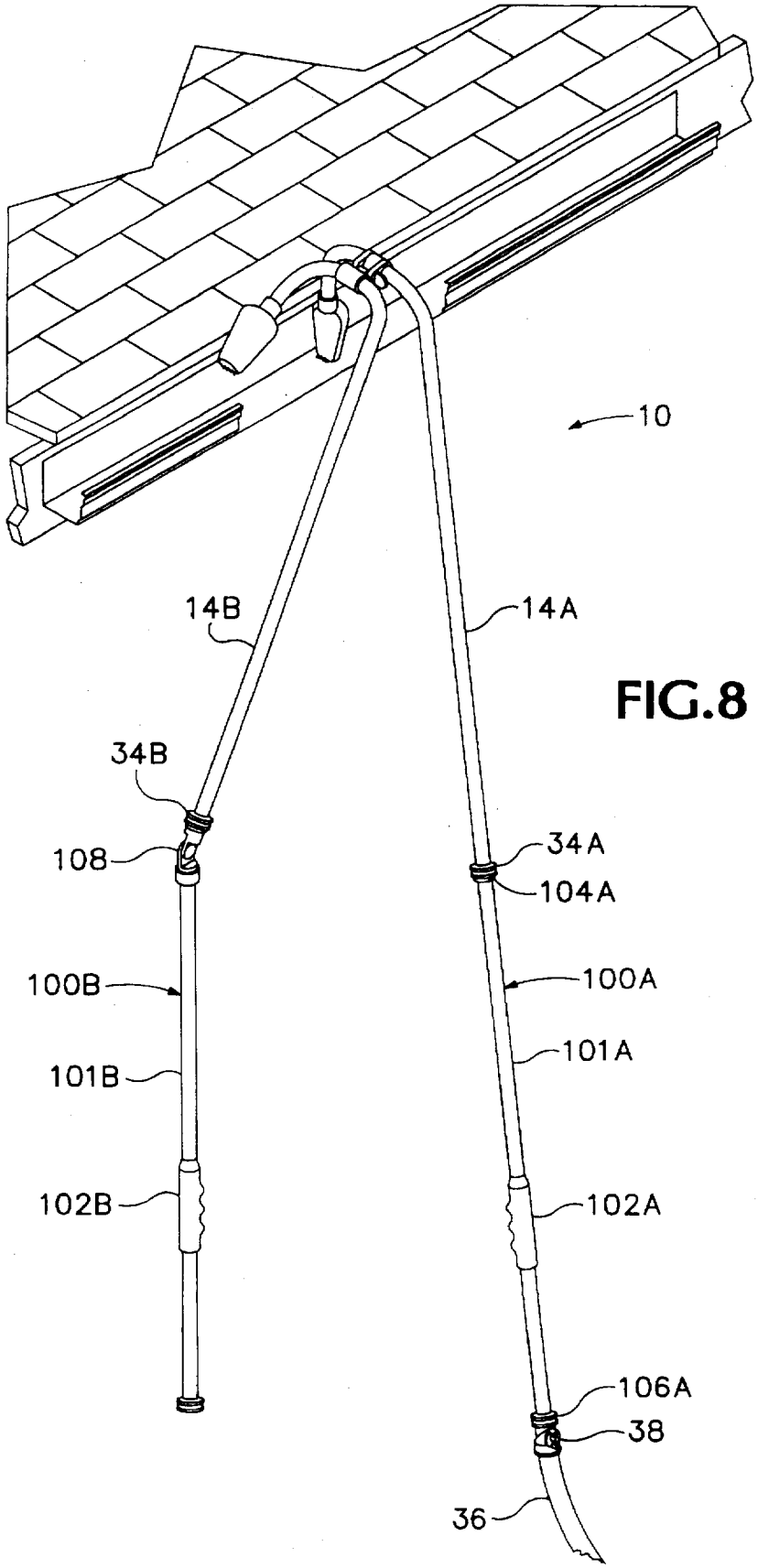
FIG. 8 is a perspective view of an the gutter cleaner of FIG. 1 showing optional extension arms.

Referring now to FIG. 8, the gutter cleaner 10 of the present invention is shown with a first extension arm 100A and a second extension arm 100B configured for right-hand operation. First extension arm 100A includes a hollow tubular shaft 101A having a passageway for transporting liquids. Extension arm 100A also includes a coupling 104A having a male thread attached to one end of extension arm 100A and a coupling 106A having a female thread attached to the other end. Couplings 104A and 106A are connected by the internal passageway running the length of shaft 101A. Extension arms 100A,B have handle grips 102A and 102B similar to those on handle arms 14A and 14B of J-shaped members 12A and 12B.

The first extension arm 100A is connected to the right handle arm 14A by threading the mail coupling 104A into female coupling 34A, thereby providing a liquid-tight seal between the extension arm and the handle arm.

Figure 9:
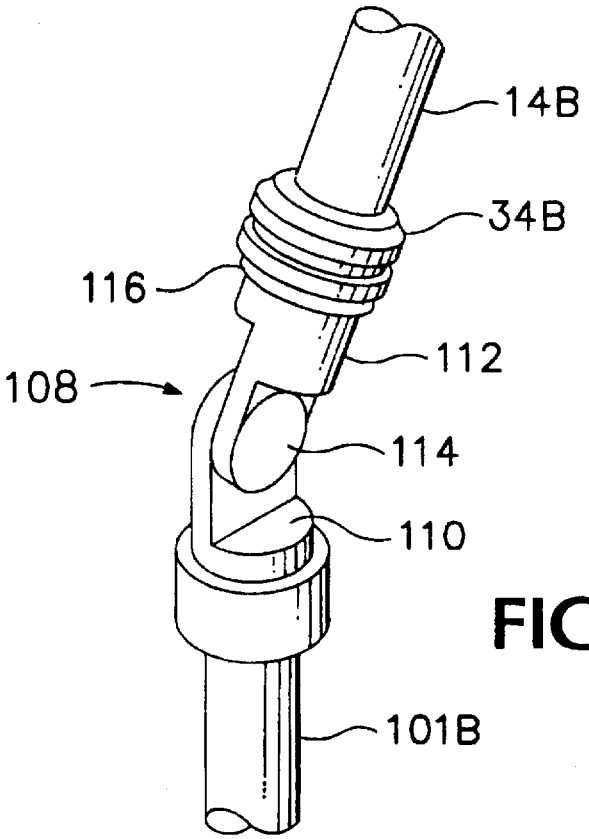
FIG. 9 is a perspective view of an embodiment of a pivot joint in accordance with the present invention.

Second extension arm 100B includes a shaft 101A which may be hollow or solid. Second extension arm 100B is connected to left handle arm 14B by a pivoting joint 108. Referring to FIG. 9, pivoting joint 108 includes a lower pivot member 110, an upper pivot member 112 and a pivot pin 114. Lower pivot member 110 is attached to the upper end of shaft 101B and is pivotally attached to upper pivot member 112 with pivot pin 114. Upper pivot member 112 includes a threaded portion 116 which is threaded into coupling 34B of left handle arm 14B, thereby pivotally connecting handle arm 14B and extension arm 100B.

Figure 10:
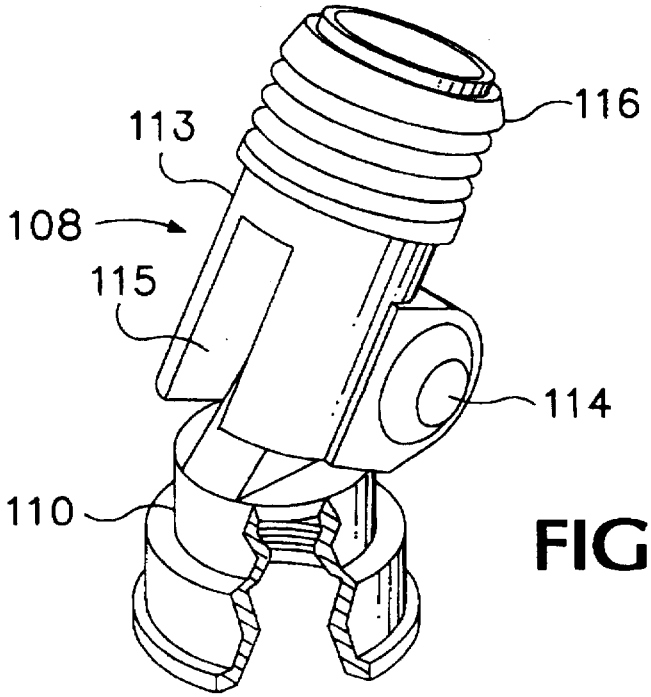
FIG. 10 is a perspective view of an embodiment of a pivot joint in accordance with the present invention.

FIG. 10 shows an alternative embodiment of pivoting joint 108. In this embodiment, the upper pivot member 113 is L-shaped and includes slot 115 for receiving lower pivot member 110. The pivot pin 114 is offset from the center line of the pivoting joint such that, when the axes handle arm 14B and extension arm 101B are aligned along a single line, the joint can only pivot in one direction.

Referring again to FIG. 8, garden hose 36 is connected to coupling 106A of first extension arm 100A through valve 38.

Alternatively, gutter cleaner 10 can be configured for left-hand operation. In left-hand mode, first extension arm 100A is connected to left handle arm 14B, and second extension arm 100B is connected to right handle arm 14A. Garden hose 36 is then connected to coupling 106A through valve 38.

A mirror (not shown) can optionally be attached mechanically to either J-shaped members 12A or 12B. Such attachment may involve a separate component part attached directly to either member or could be integral to an appendage on hinge 20.

More detailed consideration will now be given to the operation of the gutter cleaner 10 with reference to FIGS. 1, 8 and 11. The operation will be described for the right-hand mode of operation. The operation in the left-hand mode is essentially the same, but with all steps performed in mirror image orientation.

Referring to FIG. 1, garden hose 30 is first connected to coupling 34A through valve 38.

Figure 11:
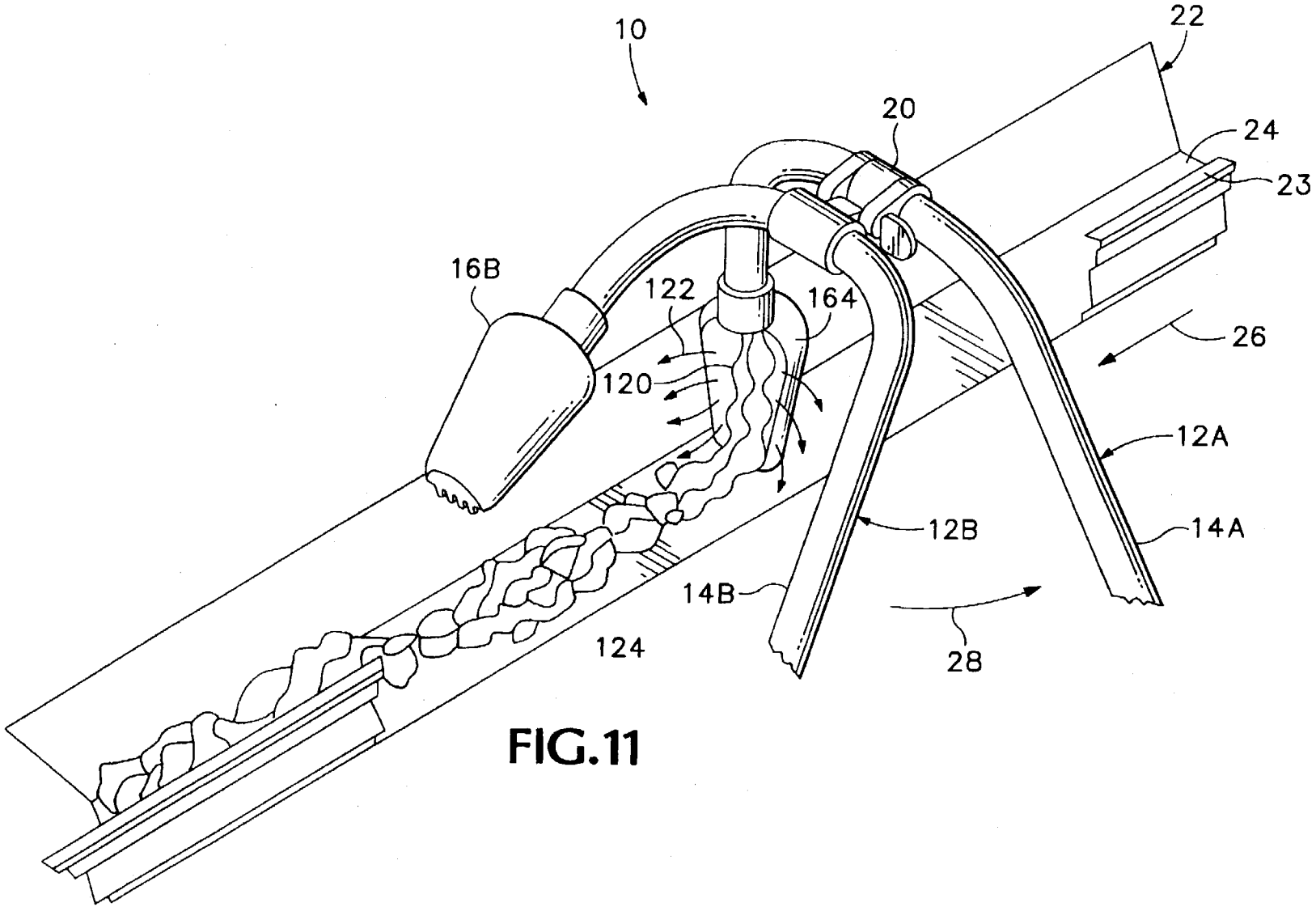
FIG. 11 is a perspective view of the gutter cleaner of FIG. 1 showing more operational detail.
Figure 12:
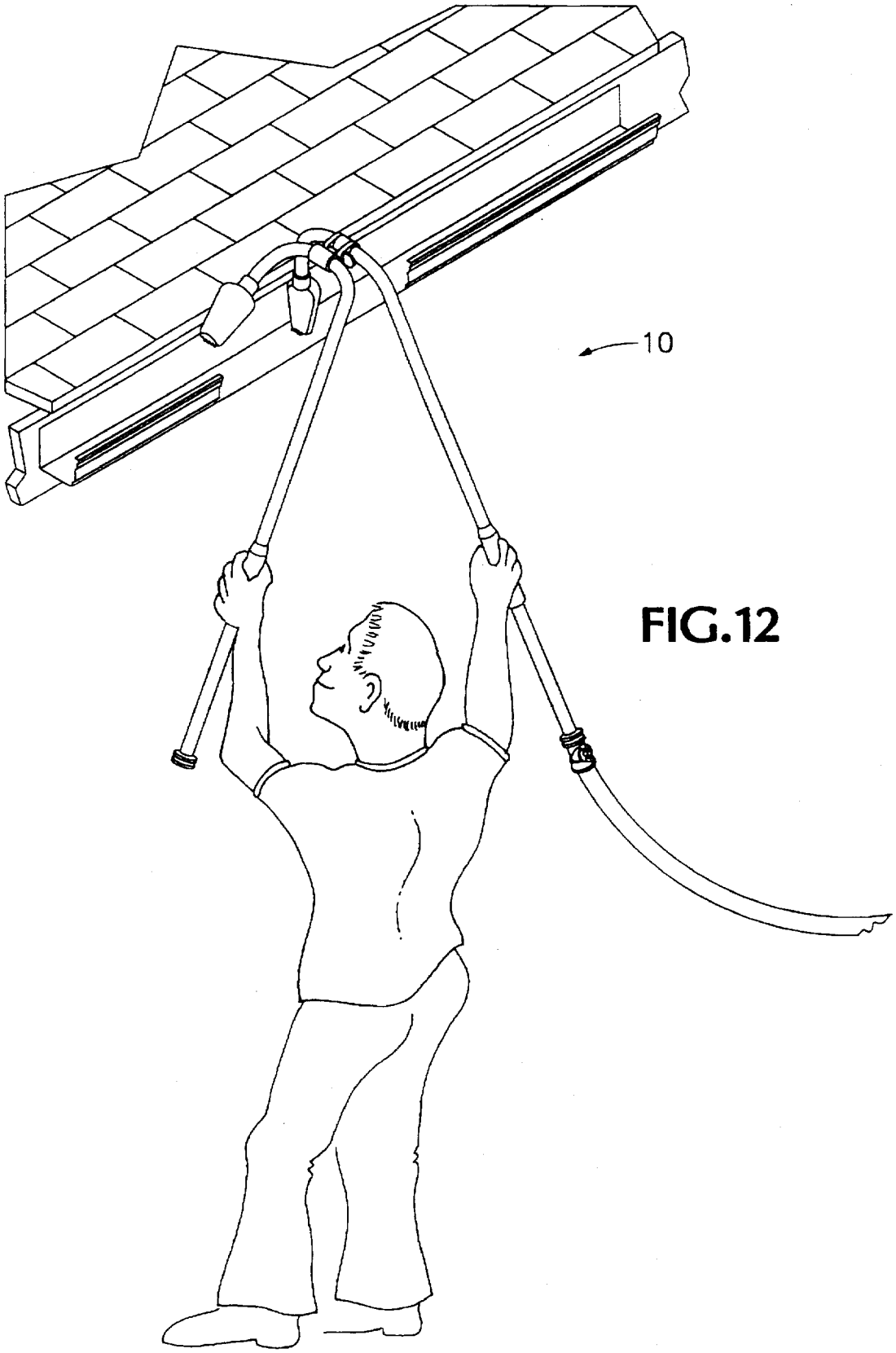
FIG. 12 is a perspective view showing an operator manipulating the gutter cleaner of FIG. 1.

Referring to FIG. 11, using handle grips 30A and 30B, left J-shaped member 12B is pivoted away from right J-shaped member 12A such that the gutter cleaner 10 placed in an open position with handle arms 14A and 14B rotated at approximately a 60 degree angle. The entire cleaner is lifted over the front lip 23 of gutter 22 and then lowered such that scoop 16A contacts the bottom of trough 24 and the right inverted J-shaped member 12A is generally in a horizontal plane that is oriented substantially normal to the axis of gutter 22. Depending on the level of induration of leaves and other debris 124 present in the gutter, it may be necessary to use the leverage provided by handle arms 14A,B to force the scoop into the bottom of the trough.

The gutter cleaner can be operated with or without a water supply. If water is used, the valve 38 is opened and pressurized water flows through rigid tube 40A. The water 120 is directed by the baffle into the curved inner surface of scoop 16A. The water then flows out of the scoop and under leaves and other debris 124 as shown by arrows 122, thereby dislodging and moving the debris along the trough 24. The ellipsoidal shape of the scoops helps direct the water under the debris.

The entire gutter cleaner 10 is next slid along the gutter to the left as shown by arrow 26 while maintaining the right J-shaped member 12A in the vertical plane, thereby accumulating debris in front of scoop 16A. The handle arms 14A and 14B provide leverage for sliding the debris, especially if handle arm 14B is used to pull the entire gutter cleaner along the gutter. Because the injection molded plastic scoops are somewhat pliable, they conform to the cross sectional shape of the gutter trough for better scraping action. If the embodiment of the scoop with the bristles shown in FIG. 5 is used, the bristles sweep debris from the bottom of the trough.

Once a suitable amount of debris has accumulated in front of scoop 16A, handle arm 14B is then rotated back towards handle arm 14A as shown by arrow 28 in FIG. 11. This causes scoops 16A and 16B to pivot toward each other, thereby grasping the accumulated debris between them. Handle arms 14A and 14B and hinge 20 provide fulcrum-like leverage for securely grasping the debris.

The entire gutter cleaner is next lifted vertically to extract the debris from the trough. The ellipsoidal shape of the scoops makes the scoops less likely to snag on obstacles as they are lifted from the trough.

If one of the alternative embodiments of the scoops shown in FIGS. 3 and 4 is used, the cleaner can be held above the trough momentarily as water drains through the holes 78 in the scoop. The use of both handle arms 14A,B provides additional leverage when lifting the cleaner. The cleaner is then moved away from the gutter and the debris emptied into a suitable receptacle.

If debris in the gutter is particularly indurated or cemented together by organic adhesives, the tooth like projections 62A of the scoop shown in FIG. 2 will help the scoop penetrate into the debris.

Having described and illustrated the principles of the invention in a preferred embodiment thereof, it should be apparent that the invention can be modified in arrangement and detail without departing from such principles. For example, rigid tube 40A need not have a circular cross sectional shape along its entire length, but it could have any suitable cross sectional shape as long as the journal portion is cylindrical. Similarly, the fluid used need not be water, but could be an suitable cleaning fluid under pressure. I claim all modifications and variation coming within the spirit and scope of the following claims.

I claim:

1. A gutter cleaner comprising:

a first member having a handle arm and a scoop that accumulates debris; and a second member having a handle arm and a scoop;

the first and second members connected such that the scoops move toward each other to grasp debris as the handle arms are moved toward each other;

the first member shaped so as to depend downwardly below a gutter trough when the scoop of the first member is introduced into the gutter trough.

2. A gutter cleaner according to claim 1 wherein the first and second members are pivotally connected.

3. A gutter cleaner according to claim 1 further including a hinge that pivotally connects the members.

4. A gutter cleaner according to claim 3 in which the first member includes a cylinder-shaped journal portion, the hinge includes a cylindrical race, and the journal portion is disposed within the race.

5. A gutter cleaner according to claim 4 in which the hinge includes a slot communicating with the race along the entire length of the race, the slot having a width less than the diameter of the journal such that the journal can be snapped into the race.

6. A gutter cleaner according to claim 3 in which the hinge includes a removable pin for separating the members.

7. A gutter cleaner according to claim 1 in which the first member includes:

a passageway for transporting fluids to the scoop; and a baffle for directing the fluids into the scoop.

8. A gutter cleaner according to claim 7 wherein the scoop is shaped so as to direct the fluids under the debris.

9. A gutter cleaner according to claim 1 in which the first member is J-shaped.

10. A gutter cleaner according to claim 1 in which the scoop of the first member includes one or more teeth.

11. A gutter cleaner according to claim 1 in which the scoop of the first member is made from a pliable material.

12. A gutter cleaner according to claim 1 in which the scoop of the first member has an ellipsoidal shape.

13. A gutter cleaner according to claim 1 in which the first member includes a handle grip that slides along the handle arm.

14. A gutter cleaner according to claim 1 further including an extension arm connected to the handle arm of the first member, a pivoting joint connected to the handle arm of the second member, and a second extension arm connected to the pivoting joint, whereby the pivoting joint transfers a vertical force from the second extension arm to the handle arm of the second member so as to cause the scoops to move toward each other.

15. A gutter cleaner according to claim 1 wherein:

the first member has an apex portion; and the first and second handle arms are pivotally connected proximate the apex portion.

16. A gutter cleaner according to claim 1 in which the first member includes:

a passageway for transporting fluids to the scoop; and means for directing the fluids into the scoop.

17. A method for cleaning debris from a gutter trough comprising the steps of:

providing a gutter cleaner comprising a first and second scoop;

introducing the first scoop into the gutter trough;

accumulating debris within the gutter trough using the first scoop;

moving the second scoop toward the first scoop thereby grasping the accumulated debris with the scoops; and lifting the gutter cleaner from within the gutter trough thereby removing the debris.

18. A method according to claim 17 further including the step of discharging a fluid into the first scoop.

19. A method according to claim 18 further including the step of using the scoop to direct the fluid under the debris.

20. A method according to claim 17 wherein the step of accumulating debris comprises sliding the first scoop along the gutter trough.

21. A method according to claim 17 wherein the step of accumulating debris includes using a pair of handle arms to force the scoop into the debris.

22. A method for cleaning debris from a gutter trough comprising the steps of:

providing a gutter cleaner comprising a first member having a handle arm and a scoop that accumulates debris, a second member having a handle arm and a scoop, the first and second members connected such that the scoops move toward each other to grasp debris as the handle arms are moved toward each other, the first member shaped so as to depend downwardly below a gutter trough when the scoop of the first member is introduced into the gutter trough;

introducing the first scoop into the gutter trough;

accumulating debris within the gutter trough using the first scoop;

moving the second scoop toward the first scoop, thereby grasping the accumulated debris with the scoops; and lifting the gutter cleaner from within the gutter trough, thereby removing the debris.

23. A method according to claim 22 wherein the step of accumulating debris includes using the second handle to force the first scoop into the debris.

24. A method according to claim 22 wherein the step of accumulating debris includes using the second handle to pull the first scoop along the gutter trough.

25. A gutter cleaner comprising:

a first member having a handle arm and a scoop that accumulates debris; and a second member having a handle arm and a scoop;

the first and second members connected such that the scoops move toward each other to grasp debris as the handle arms are moved toward each other;

the first member shaped so as to depend downwardly below a gutter trough when the scoop of the first member is introduced into the gutter trough;

wherein the first member has an apex portion, the second member has an apex portion, and the first and second members are pivotally connected proximate the apex portions.

26. A gutter cleaner according to claim 25 wherein the first and second members are J-shaped.

* * * * *